US007946580B2

(12) United States Patent
Kato

(10) Patent No.: US 7,946,580 B2
(45) Date of Patent: May 24, 2011

(54) SHEET MATERIAL FEEDING APPARATUS WITH GUIDE MEMBERS PASSING THROUGH ROLL GROOVES

(75) Inventor: Heizaburo Kato, Kikugawa (JP)

(73) Assignee: Sankyo Seisakusho Co., Tokyo (JP)

( * ) Notice: Subject to any disclaimer, the term of this patent is extended or adjusted under 35 U.S.C. 154(b) by 271 days.

(21) Appl. No.: 12/261,356

(22) Filed: Oct. 30, 2008

(65) Prior Publication Data

US 2009/0108521 A1 Apr. 30, 2009

(30) Foreign Application Priority Data

Oct. 31, 2007 (JP) ..... 2007-283409

(51) Int. Cl.
*B65H 5/02* (2006.01)

(52) U.S. Cl. ..... 271/272

(58) Field of Classification Search ..... 271/272
See application file for complete search history.

(56) References Cited

U.S. PATENT DOCUMENTS

| | | | | |
|---|---|---|---|---|
| 3,161,335 | A * | 12/1964 | Pine et al. | 225/100 |
| 3,967,767 | A * | 7/1976 | Seragnoli | 225/96 |
| 4,415,108 | A | 11/1983 | Katoh | |
| 4,638,990 | A | 1/1987 | Kato | |
| 4,776,505 | A | 10/1988 | Kato | |
| 5,695,105 | A * | 12/1997 | Ohara | 225/96 |
| 5,720,421 | A | 2/1998 | Gentile et al. | |
| 7,503,562 | B2 * | 3/2009 | Haberstroh | 271/275 |
| 2003/0200877 | A1 | 10/2003 | Blei | |
| 2007/0063431 | A1 * | 3/2007 | Haberstroh | 271/272 |

FOREIGN PATENT DOCUMENTS

| | | | |
|---|---|---|---|
| DE | 3143177 | | 5/1982 |
| GB | 843799 | | 8/1960 |
| JP | 57199741 | A * | 12/1982 |
| JP | 63-170039 | | 11/1988 |
| JP | 05228560 | | 9/1993 |

* cited by examiner

*Primary Examiner* — Stefanos Karmis
*Assistant Examiner* — Gerald W McClain
(74) *Attorney, Agent, or Firm* — Harness, Dickey & Pierce, P.L.C.

(57) ABSTRACT

A sheet material feeding apparatus capable of favorably guiding a sheet material to perform smooth feeding comprises a pair of rolls and first and second guide members and permits a sheet material to pass between the first guide member and the second guide member. One of the rolls has a plurality of circumferential grooves arranged between both ends of a sheet material feeding surface in an axial direction and spaced from one another in the axial direction, and the first guide member includes guide portions passing through the respective circumferential grooves and extending continuously to a downstream side from an upstream side between the pair of rolls in a sheet-material conveyance direction.

2 Claims, 6 Drawing Sheets

SHEET MATERIAL FEEDING APPARATUS WITH GUIDE MEMBERS PASSING THROUGH ROLL GROOVES

CROSS-REFERENCE TO RELATED APPLICATIONS

This application claims the benefit of Japanese Patent Application No. 2007-283409, filed on Oct. 31, 2007, the contents of which are incorporated herein by reference in its entirety.

BACKGROUND OF THE INVENTION

The present invention relates to a sheet material feeding apparatus that intermittently feeds a sheet material a predetermined quantity by a predetermined quantity to a work machine such as a press apparatus, etc., and more particularly, to a sheet material feeding apparatus suited to feeding of a thin sheet material.

A new technology, such as development of hybrid cars in auto industry, etc., associated with the global environmental problem and products employing the technology are actively developed in respective industries. The hybrid technology of automobiles is based on the combination of an engine and a motor and one of themes of the technology resides in developing a further efficient motor. While motor cores used in such motors are manufactured by laminating thin sheets, which are punched by a press apparatus, in several layers, it has been found that with a view to an improvement in efficiency, it is preferable to make thin sheets, which are laminated, further thin.

In such situation, there is a tendency that a sheet material for motor cores punched by a press apparatus becomes thin yearly, and by way of example, a silicon steel plate having a thickness of 0.25 mm is used in recent years in place of a silicon steel plate having a thickness of 0.5 mm and used before. Accordingly, press apparatuses conformed to such situation have been studied and so sheet material feeding apparatuses that feed a sheet material to a press apparatus are demanded of development that suits the apparatuses to feeding of a thin sheet material.

Conventionally, a roll feed apparatus, in which a pair of rolls interpose and convey a material, is known as a sheet material feeding apparatus.

Some roll feed apparatuses are of a type comprising a main roll continuously and rotationally driven by a drive device and a sub-roll driven by the main roll through a sheet material (see, for example, U.S. Pat. No. 5,720,421).

Also, some roll feed apparatuses are of a type, in which sector-shaped rolls are used as a pair of rolls and a material is conveyed by swinging and rotationally driving the rolls (see, for example, JP-U-63-170039).

Also, there is known a sheet material feeding apparatus comprising sheet material guide means that guides a sheet material to restrict flexure of the sheet material at the time of sheet material feeding and using the sheet material guide means to guide the sheet material upstream and downstream of a pair of rolls as viewed in a sheet-material conveyance direction (see, for example, JP-U-63-170039).

Since the sheet material feeding apparatus described above intermittently feeds a sheet material to a work machine such as a press apparatus, etc. while repeating stoppage and feeding, flexure of the sheet material is liable to generate in the intermediate of a path, along which the sheet material is fed to the work machine. Also, since a pair of rolls interpose therebetween the sheet material with a sufficient interposing force to feed the same with a friction force, the sheet material in case of a thin sheet is liable to readily wind round a roll. Such flexure of and winding of the sheet material round a roll leads to degradation in accuracy for a feeding length by the sheet material feeding apparatus to be responsible for a hindrance to the work by the work machine.

In the related art described in the JP-U-63-170039, the sheet material guide means performs guidance upstream and downstream of the pair of rolls as viewed in the sheet-material conveyance direction to restrict flexure of the sheet material but it is difficult to prevent flexure of and winding of the sheet material round a roll since a wide space is provided between the sheet material guide means and the rolls.

SUMMARY OF THE INVENTION

It is an object of the invention to provide a sheet material feeding apparatus that dissolves the problem described above and can smoothly feed a sheet material to a work machine without the generation of flexure of and winding of the sheet material round a roll.

In order to solve the problem described above, the sheet material feeding apparatus according to the invention comprises a pair of rolls that cooperate with each other to interpose therebetween and convey a sheet material, and a sheet material guide device including a first guide member and a second guide member, which extend along a sheet material conveyance path, and configured to pass a sheet material between the guide members, one of the pair of rolls having a plurality of circumferential grooves arranged between both axial ends of a sheet material feeding surface and spaced from one another in the axial direction, the first guide member including guide portions passing through the plurality of circumferential grooves and extending continuously to a downstream side from an upstream side between the pair of rolls in a sheet-material conveyance direction.

In the invention, the guide portions of the first guide member pass through the plurality of circumferential grooves and extend continuously to a downstream side from an upstream side between the pair of rolls in a sheet-material conveyance direction, and the guide portions guide a sheet material when the sheet material passes between the pair of rolls. Accordingly, even when a sheet material is thin, flexure of and winding of the sheet material round a roll are hard to generate and it is possible to smoothly feed the sheet material with high accuracy.

A construction is preferable, in which the other of the pair of rolls, which cooperates with the one of the pair of rolls, has a plurality of circumferential grooves arranged between both ends of a sheet material feeding surface in an axial direction and spaced from one another in the axial direction, the second guide member includes guide portions passing through the plurality of circumferential grooves on the other of the pair of rolls and extending continuously to a downstream side from an upstream side in a sheet-material conveyance direction, and the guide portions of the first guide member and the guide portions of the second guide member are arranged in opposition to each other to permit a sheet material to pass between the guide portions and the guide portions. With such construction, the guide portions of the first guide member and the guide portions of the second guide member guide a sheet material, so that stable feeding of a sheet material is made possible.

DESCRIPTION OF THE PREFERRED EMBODIMENTS

Embodiment 1

Figure 1:
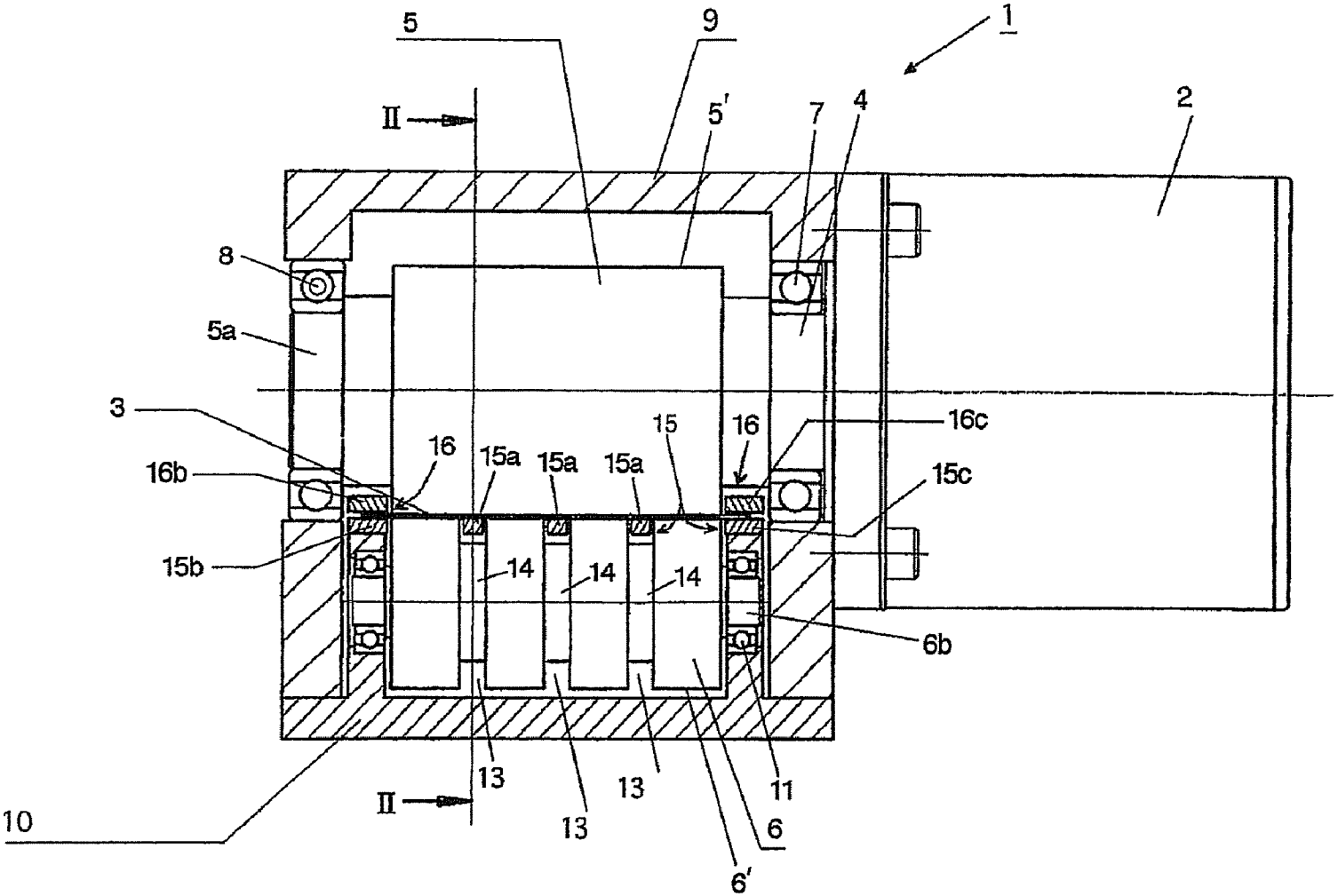
FIG. 1 is an axial, cross sectional view showing a sheet material feeding apparatus according to Embodiment 1 of the invention.

A sheet material feeding apparatus 1, according to Embodiment 1, shown in FIGS. 1 and 2 comprises a pair of rolls, that is, an upper, main roll 5 driven by a drive device 2 such as servomotor or the like, a lower, sub-roll 6 driven through a sheet material 3 by the main roll 5, and sheet material guide means described later in detail.

A housing that accommodates therein the main roll 5 and the sub-roll 6 includes a first housing portion 9 having a wall portion that supports the main roll 5, and a second housing portion 10 mounted to the first housing portion 9 to support the sub-roll 6. One end 5*b* of the main roll 5 is connected to a driving shaft 4 of the drive device 2, the driving shaft 4 being supported rotatably on the first housing portion 9 with a bearing member 7 therebetween. The other end 5*a* of the main roll 5 is supported rotatably on the first housing portion 9 with a bearing member 8 therebetween. Both ends 6*a*, 6*b* of the sub-roll 6, respectively, are supported rotatably on the second housing portion 10 with bearing members 11, 12 therebetween.

The sheet material feeding apparatus 1 is fixed to a work machine (not shown) such as a press apparatus, etc. and the drive device 2 intermittently rotates the main roll 5 to convey the sheet material 3 interposed by the main roll 5 and the sub-roll 6 to feed the same a predetermined quantity by a predetermined quantity to the work machine.

In addition, a sheet material feeding apparatus of a type, in which a pair of rolls interpose and convey a sheet material, is usually provided with a mechanism that operates in synchronism with the operation of a press apparatus to release an interposing force, applied to the sheet material by the pair of rolls, just before press working, and a mechanism that adjusts a clearance between the pair of rolls according to the thickness of the sheet material. It suffices to appropriately adopt a known construction for these mechanisms.

The sheet material guide means or device includes a first guide member 15 and a second guide member 16, which are fixed to the housing portions 9, 10.

Figure 2:
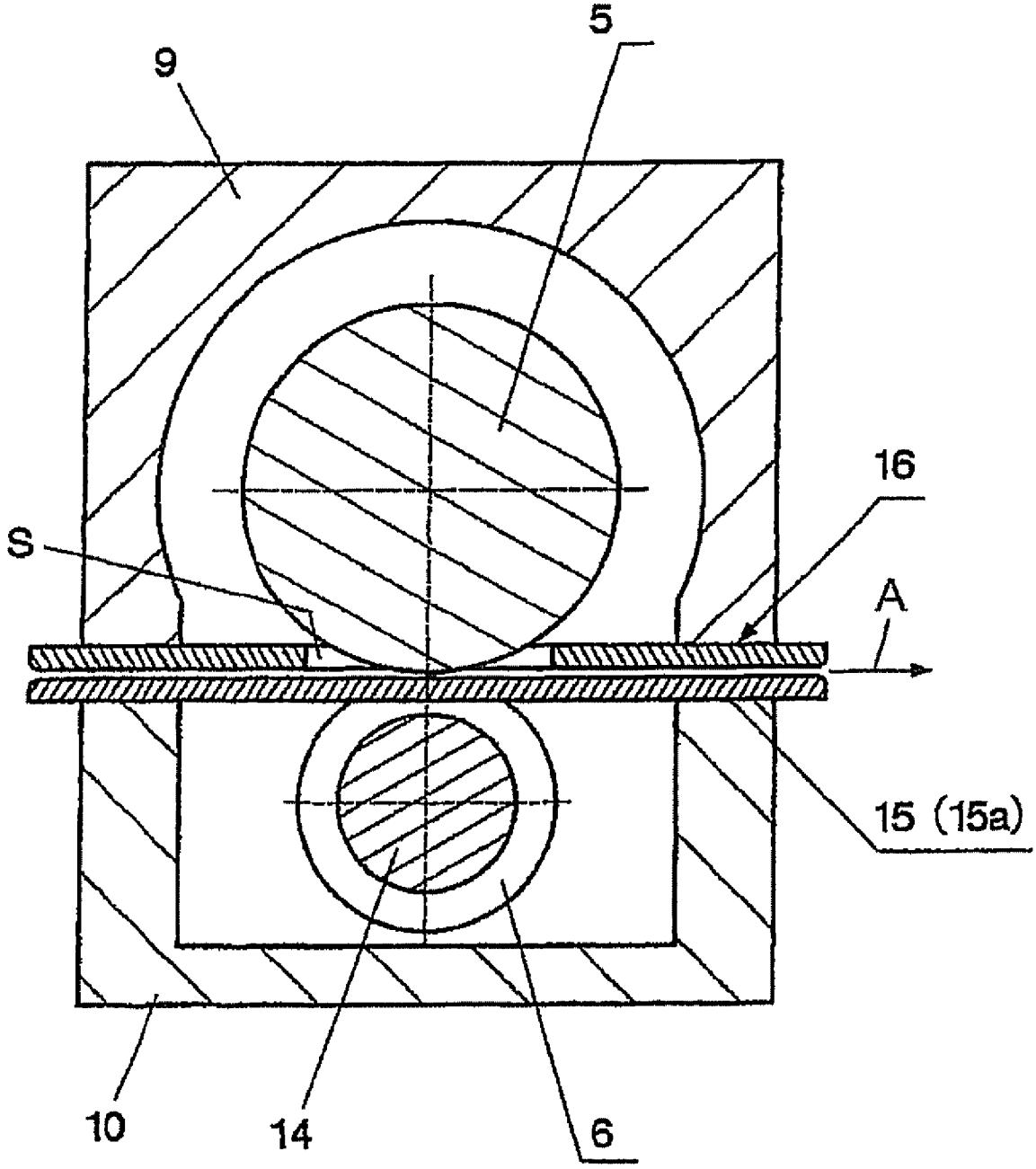
FIG. 2 is a cross sectional view as viewed in an arrow direction II-II in FIG. 1.

The second guide member 16 includes a portion positioned upstream of the both rolls 5, 6 as seen in a sheet-material conveyance direction indicated by an arrow A in FIG. 2 and a portion positioned downstream thereof and a space S is formed between these portions and the main roll 5. As shown in FIG. 1, the both ends 5*a*, 5*b* of the main roll 5 are formed to have a smaller diameter than that of an outer peripheral surface, that is, a sheet material feeding surface 5' that engages with the sheet material 3 to feed the same, and the second guide member 16 includes guide portions 16*b*, 16*c* passing through positions adjacent to peripheral surfaces of the both ends 5*a*, 5*b* and extending continuously to a downstream side of the both rolls 5, 6 from an upstream side thereof in the sheet-material conveyance direction.

Provided on an outer peripheral surface of the sub-roll 6, that is, a sheet material feeding surface 6' that engages with the sheet material 3 to feed the same are a plurality of circumferential grooves 13 spaced from one another in an axial direction of the sheet material feeding surface, small-diameter portions 14 of the sheet material feeding surface 6' being provided in locations, in which the circumferential grooves 13 are provided.

The first guide member 15 includes guide portions 15*a* passing through the respective circumferential grooves 13 and extending continuously to a downstream side from an upstream side between the both rolls 5, 6 in the sheet-material conveyance direction. Also, the first guide member 15 includes guide portions 15*b*, 15*c* positioned in the vicinity of the both ends 6*a*, 6*b* of the sub-roll 6. The guide portions 15*a*, 15*b* are fixed to a wall portion of the second housing portion 10 that supports the both ends 6*a*, 6*b* of the sub-roll 6 with the bearing members 11, 12 therebetween, the guide portions extending continuously to a downstream side of the both rolls 5, 6 from an upstream side thereof in the sheet-material conveyance direction and opposing to the guide portions 16*b*, 16*c* of the second guide member 16 to permit the sheet material 3 to pass between the guide portions 15*a*, 15*b* and the guide portions 16*a*, 16*b*.

The plurality of guide portions 15*a*, 15*b*, 15*c*, respectively, may comprise separate members fixed to the housing portions 9, 10 and may be connected integrally in positions upstream and downstream of the both rolls 5, 6.

As described above, according to Embodiment 1, since the first guide member 15 having the guide portions 15*a* is provided, it is possible to preferably guide and smoothly feed the sheet material 3 without the generation of flexure and bending on the sheet material 3.

Figure 3A:
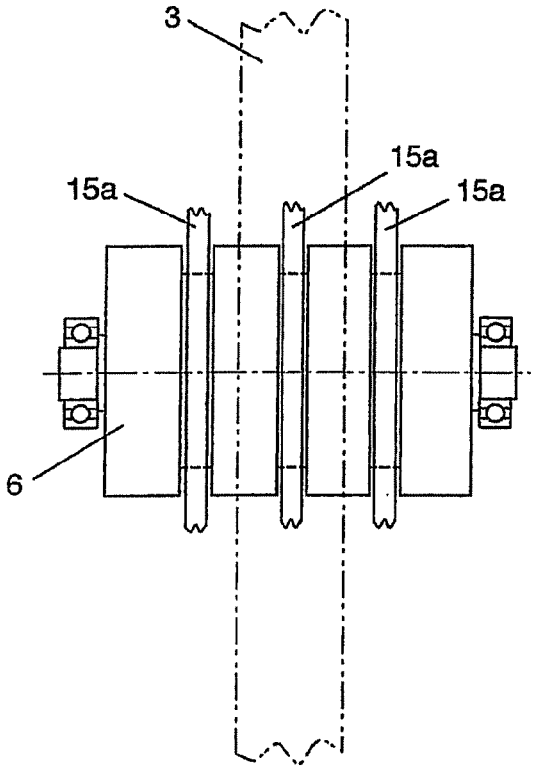
FIGS. 3A and 3B are views illustrating meritorious effects produced when a first guide member according to Embodiment 2 is used.
Figure 3B:
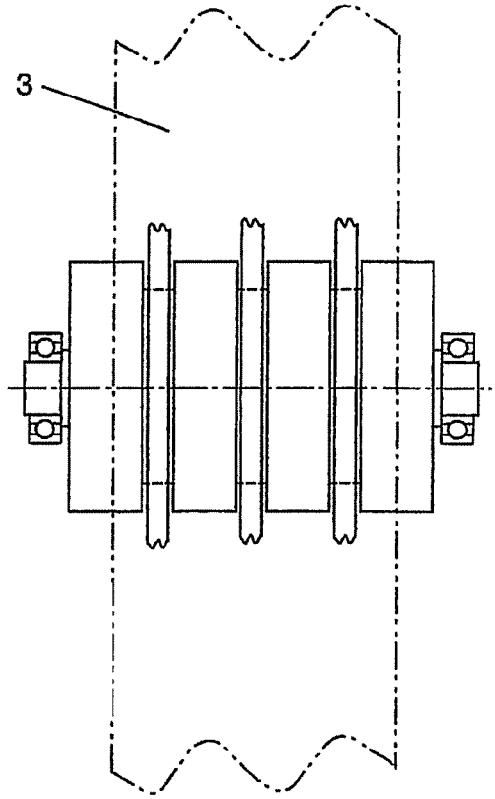

According to Embodiment 1, since the first guide member 15 includes three guide portions 15*a*, it is possible to smoothly feed sheet materials of various widths. That is, when a sheet material 3 has a small width as shown in FIG. 3A, at least one guide portion 15*a* guides a sheet material, and when a sheet material 3 has a large width as shown in FIG. 3B, a plurality of guide portions 15*a* guide a sheet material to enable smoothly feeding the sheet material.

In addition, while the circumferential grooves 13 and the guide portions 15*a* are provided in plural in order to smoothly feed sheet materials of various widths, it suffices to appropriately select the specific number thereof according to a width of a sheet material being conveyed. Also, it does not matter whether the guide portions 15*b*, 15*c*, 16*b*, 16*c* positioned at ends of the both rolls 5, 6 are omitted according to a situation. This is the same in Embodiments 2, 3, and 4.

Embodiment 2

Figure 4:
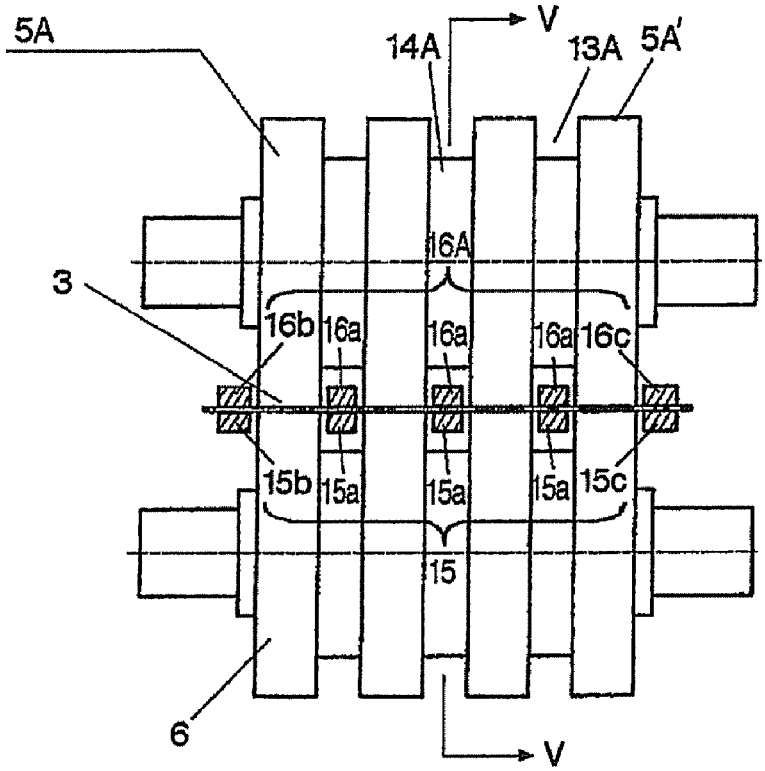
FIG. 4 is a view showing the construction of a pair of rolls and first and second guide members according to Embodiment 2.

Embodiment 2 shown in FIG. 4 comprises a sub-roll 6 and a first guide member 15, which are the same as those in Embodiment 1, the first guide member 15 having guide portions 15*a* to 15*c* being the same as those in Embodiment 1.

In Embodiment 2, a main roll 5A and a second guide member 16A are structured in the same manner as the sub-roll 6 and the first guide member 15 are.

That is, a sheet material feeding surface 5A' of the main roll 5A is provided with a plurality of circumferential grooves 13A, which are spaced from one another in an axial direction of a sheet material feeding surface, and small-diameter portions 14A of the main roll 5A are provided in locations, in which the circumferential grooves are provided. The second guide member 16A includes guide portions 16*a* passing through the respective, circumferential grooves 13A and extending continuously to a downstream side from an upstream side in a sheet-material conveyance direction, and guide portions 16*b*, 16*c* being the same as the guide portions 16*b*, 16*c* in Embodiment 1. The guide portions 16*a* to 16*c* are arranged in opposition to the guide portions 15*a* to 15*c* of the first guide member 15 to permit a sheet material 3 to pass between the guide portions 15*a* to 15*c* and the guide portions 16*a* to 16*c*.

Figure 5:
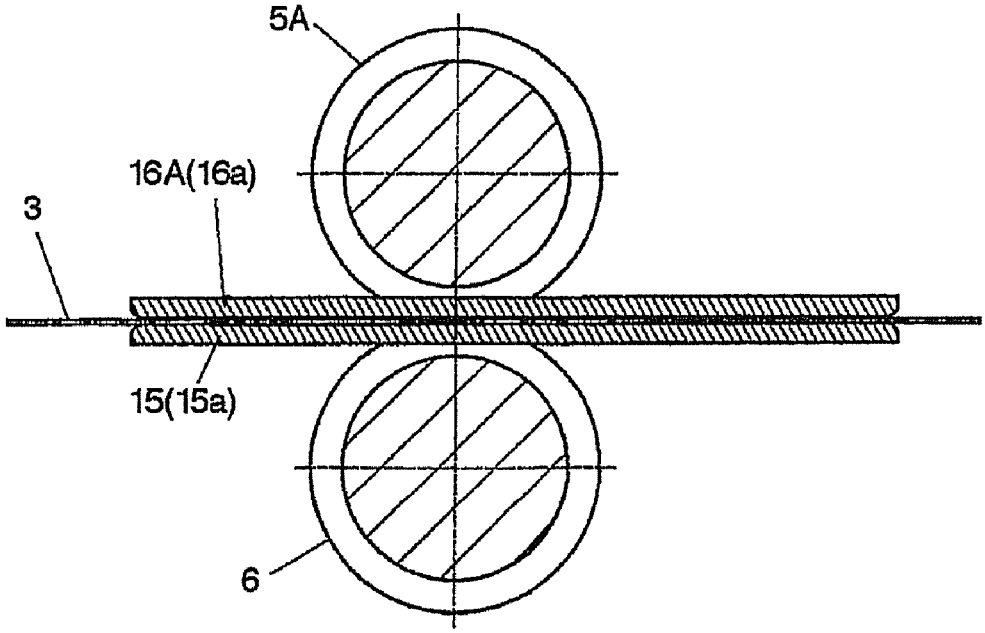
FIG. 5 is a cross sectional view taken along the line V-V in FIG. 4.

As apparent from FIGS. 4 and 5, according to Embodiment 2, the guide portions 15*a* to 15*c* of the first guide member 15 and the guide portions 16*a* to 16*c* of the second guide member 16A regulate both surfaces of a sheet material passing between the both rolls to enable stably feeding the sheet material.

Figure 8:
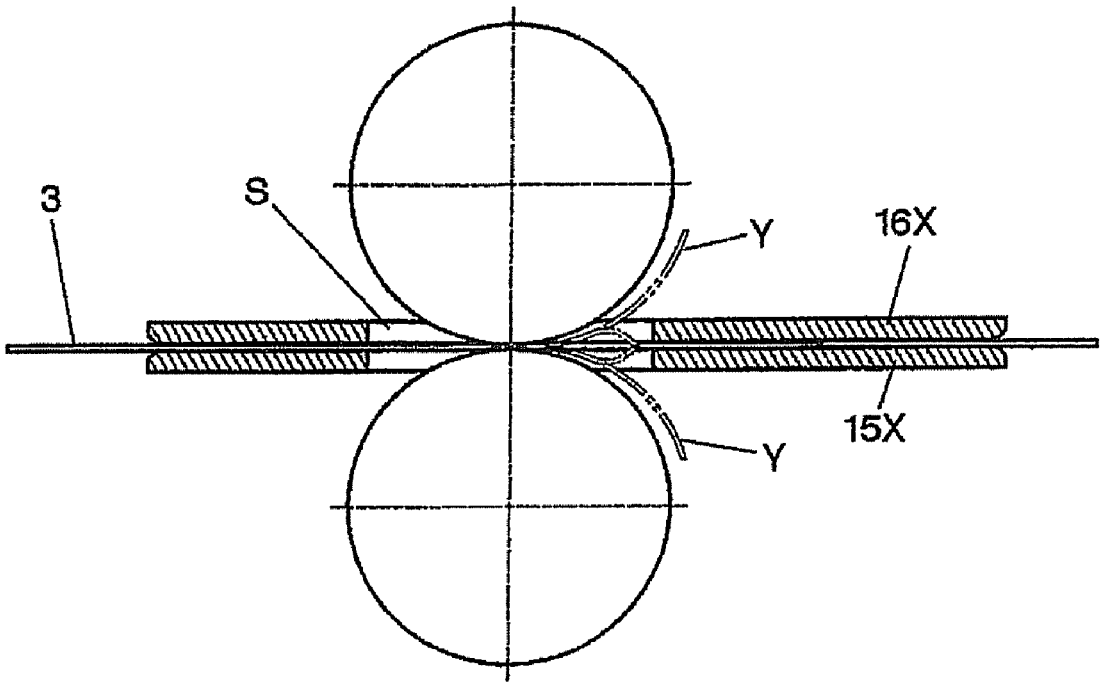
FIG. 8 is a view showing the construction of the related art and being the same as FIG. 5.

In contrast, in a related art shown in FIG. 8, guide members 15X, 16X do not include any guide portions extending continuously to a downstream side from an upstream side between a pair of rolls in a sheet-material conveyance direction and a space S is formed between the guide members 15X, 16X and the pair of rolls, so that flexure of and winding Y of a sheet material 3 around a roll are brought about.

Embodiment 3

Figure 6:
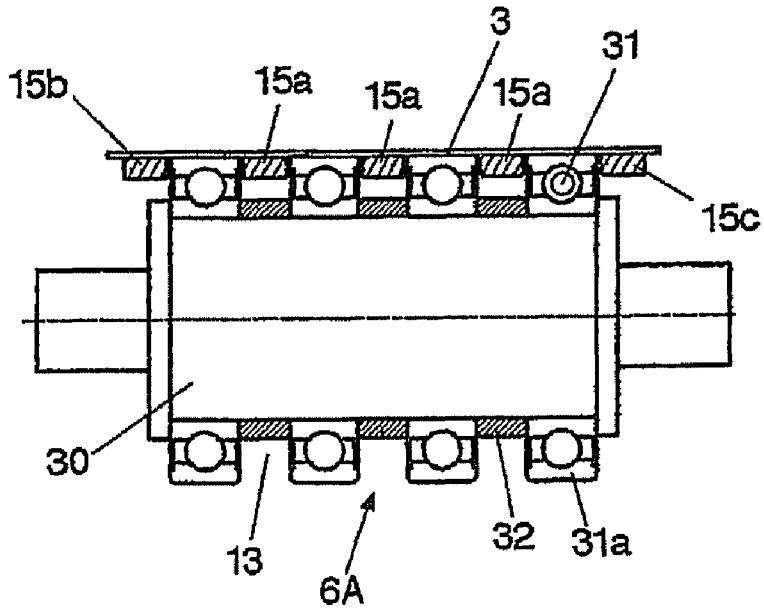
FIG. 6 is a view showing the construction of a sub-roll and a first guide member according to Embodiment 3.

In Embodiment 3 shown in FIG. 6, a sub-roll 6A includes a roll shaft 30, both ends of which are fixed to a housing of a sheet material feeding apparatus, and a plurality of bearing members 31 mounted in positions spaced from one another in an axial direction of the roll shaft 30. Spacers 32 are provided between the respective bearing members 31. Preferably, deep groove bearings are used for the bearing members 31.

Outer peripheral surfaces of outer rings 31*a* of the respective bearing members 31 define sheet material feeding surfaces. Also, a plurality of circumferential grooves 13 are formed in positions between the respective bearing members 31 and guide portions 15*a* are provided to pass through the respective circumferential grooves 13 and extend continuously to a downstream side from an upstream side in a sheet-material conveyance direction. Guide portions 15*b*, 15*c* shown in FIG. 6 are the same as the guide portions 15*b*, 15*c* in Embodiments 1 and 2.

According to Embodiment 3, it is not necessary to mount the roll shaft 30 rotatably to a housing. That is, the sub-roll 6A is not rotated as a whole together with the roll shaft 30 but the outer rings 31*a* of the respective bearing members 31 are rotated through a sheet material 3 by a main roll, so that a small force can give rise to rotation without the generation of a large inertial force. Accordingly, it is possible to make the construction simple and to further smoothly feed a material.

Embodiment 4

Figure 7:
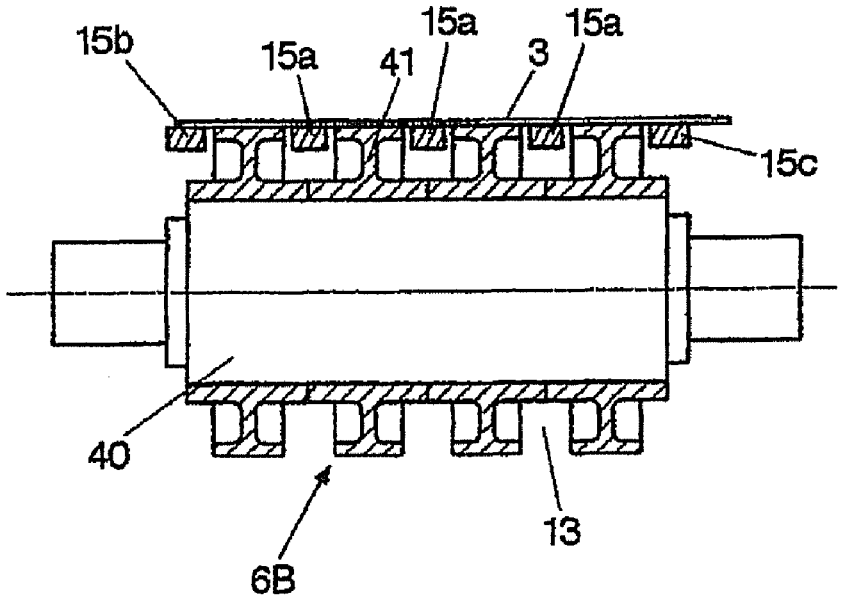
FIG. 7 is a view showing the construction of a sub-roll and a first guide member according to Embodiment 4.

In Embodiment 4 shown in FIG. 7, a sub-roll 6B includes a roll shaft 40 and a plurality of roll members 41 mounted to the roll shaft 40 in a mutually adjoining relationship in an axial direction of the roll shaft 40. A plurality of circumferential grooves 13 are formed in positions between the respective roll members 41 and guide portions 15*a* are provided to pass through the respective circumferential grooves 13 and extend continuously to a downstream side from an upstream side in a direction, in which a sheet material 3 is conveyed. The reference numerals 15*b*, 15*c* in FIG. 7 denote guide portions being the same as the guide portions 15*b*, 15*c* in Embodiments 1 to 3.

Generally, when a sheet material being conveyed is large in width, a roll becomes large in size and also in length, and a troublesome work is needed to accurately finish a sheet material feeding surface of such large and lengthy roll. With a construction, in which the plurality of roll members 41 are provided as in Embodiment 4, finishing can be performed readily and accurately by subjecting all the roll members 41 to finishing at a time in a state, in which the roll members 41 are mounted to the roll shaft 40.

Also, when the construction of Embodiment 4 is adopted, a sub-roll can be made light in weight or the like by contriving the shape of the respective roll members 41.

The structure of the roll, according to Embodiment 3, shown in FIG. 6 cannot be adopted as the structure of a main roll but the structure of the roll, according to Embodiment 4, shown in FIG. 7 can be adopted as the structure of a main roll. Also, the structures of the rolls shown in FIGS. 4, 6, and 7 can be appropriately combined and used for the structures of a main roll and a sub-roll. For example, it is possible to adopt the structure of the roll shown in FIG. 7 for each of a pair of rolls for conveyance of a sheet material, to adopt the structure of the roll shown in FIG. 7 for the structure of a main roll for cooperation with a sub-roll, which has the structure shown in FIG. 6, and to replace the main roll 5A, according to Embodiment 4, shown in FIG. 4 by a main roll, which has the structure shown in FIG. 7.

The invention claimed is:

1. A sheet material feeding apparatus comprising:

a pair of rolls that cooperate with each other to interpose therebetween and convey a sheet material, and a sheet material guide device including a first guide member and a second guide member, which extend along a sheet material conveyance path, and configured to pass a sheet material between the guide members, wherein one of the pair of rolls has a plurality of circumferential grooves arranged between both axial ends of a sheet material feeding surface and spaced from one another in the axial direction, and the first guide member includes guide portions passing through the plurality of circumferential grooves and extending continuously to a downstream side from an upstream side between the pair of rolls in a sheet material conveyance direction, and wherein the pair of rolls comprise a main roll driven by a drive device and a sub-roll driven through a sheet material by the main roll, the sub-roll comprises the one of the pair of rolls and includes a roll shaft, both ends of which are non-rotatably fixed to a housing of the sheet material feeding apparatus, and a plurality of bearing members mounted in positions spaced from one another in an axial direction of the roll shaft, outer peripheral surfaces of outer rings of the respective bearing members define a sheet material feeding surface of the one of the pair of rolls, and each of the plurality of circumferential grooves is formed in a position between the respective bearing members.

2. The sheet material feeding apparatus according to claim 1, wherein the other of the pair of rolls, which cooperates with the one of the pair of rolls, has a plurality of circumferential grooves arranged between both axial ends of a sheet material feeding surface and spaced from one another in the axial direction, the second guide member includes guide portions passing through the plurality of circumferential grooves on the other of the pair of rolls and extending continuously to a downstream side from an upstream side in a sheet-material conveyance direction, and the guide portions of the first guide member and the guide portions of the second guide member are arranged in opposition to each other to permit a sheet material to pass between the guide portions of the first guide member and the guide portions of the second guide member.

* * * * *